United States Patent [19]

O'Toole et al.

[11] 4,113,330

[45] Sep. 12, 1978

[54] HOLDER FOR DOCUMENTATION CARTRIDGE

[75] Inventors: Jerome M. O'Toole, Spartanburg, S.C.; Edmund T. Paquette, Shrewsbury, Mass.

[73] Assignee: Wright Line Inc., Worcester, Mass.

[21] Appl. No.: 832,729

[22] Filed: Sep. 12, 1977

[51] Int. Cl.[2] ..... A47B 63/00; B42D 17/00

[52] U.S. Cl. ..... 312/184; 312/233

[58] Field of Search ..... 312/184, 185, 233

[56] References Cited

U.S. PATENT DOCUMENTS 3,980,360 9/1976 Wright et al. ..... 312/184

4,056,296 1/1977 Hedstrom et al. ..... 312/184

*Primary Examiner*—Kenneth Downey
*Assistant Examiner*—Alex Grosz
*Attorney, Agent, or Firm*—Milton E. Gilbert

[57] ABSTRACT

Apparatus is disclosed for supporting a document-holding cartridge in a position that permits the documents to be read easily. The cartridge is held on its spine in a position reversed from its normal document-supporting position and means are provided to keep it from tipping sideways by appropriately engaging one of the cartridge hooks by which the cartridge is held in its normal upright position.

17 Claims, 7 Drawing Figures

HOLDER FOR DOCUMENTATION CARTRIDGE

BACKGROUND OF THE INVENTION

The present invention relates in general to documentation cartridges and in particular to a holder for supporting a documentation cartridge in a reversed position which permits documents fastened together by the cartridge to be easily read.

Cartridges which fasten together sheets of documents along one edge and support them in a hanging position are well known in the art. An example of such a device is illustrated and described in U.S. Pat. No. 3,980,360, which is assigned to the assignee of the present application. Cartridges of this type frequently have a channel-form configuration and document sheets are inserted into the open portion of the channel. The sheets are held in place by means of removable posts which engage the side walls of the channel as well as predetermined holes spaced along one edge of the sheets.

In its normal upright position, the document-carrying cartridge may be supported by a pair of support hooks which extend from opposite ends of the channel and which engage transversely extending rods or the like. If the documents carried by the cartridge are heavy, the cartridge, supported by the aforesaid hooks which are positioned at opposite cartridge ends, may sag in the center unless the back of the channel is strengthened. In the cartridge disclosed in the aforesaid patent, this is accomplished by a pair of surfaces which converge above the channel proper and meet in a common spine which extends substantially the full length of the channel. The sloping surfaces thus form a garret space above the closed portion of the channel, which is integral with the channel and which serves to strengthen the latter against bending. Cartridges such as those disclosed in the aforesaid patent may be molded or otherwise made in the channel-form described, e.g. as an integral structure with parallel side walls and a mutually perpendicular back wall running the full length of the channel and having a pair of transverse end walls which terminate the channel at opposite ends. Further, the converging walls which rise above the closed back portion of the channel and which are terminated at opposite ends by a pair of slanted end walls, are part of the integral structure which additionall, includes the aforesaid hooks. The hooks preferably extend the full width of the channel and each forms a transverse slot which is open in the same direction as the channel itself.

In an alternative embodiment, the above-described cartridge is molded as identical halves which are pivotably joined together along the aforesaid spine. In the latter case, due to the nature of the molding process, the spine may carry a thin ridgelet superimposed thereon. As distinguished from the type of cartridge in which the channel is molded as an integral structure, a cartridge with pivotable halves is capable of opening so as to provide easier and often quicker access to the desired documents.

While cartridges of the type described readily permit selected document sheets to be removed or replaced, such is not usually necessary when it is only desired to read the cartridge-fastened documents in the manner of a book. To do so, the cartridge is removed from the rods engaged by the hooks and its position is reversed. Thus, the sheets are positioned above the cartridge and can be opened and read. However, the presence of the narrow spine makes the position of the cartridge unstable so that it tends to tip to one or the other side. In the sideways position of the cartridge, reading of the sheets becomes far more difficult, particularly those pages which face down, i.e. away from the reader. Additionally, there is a greater tendency for the sheets to return to their closed position, which further increases the difficulty and the time required for reading document sheets held in the cartridge.

OBJECTS OF THE INVENTION

Accordingly, it is a primary object of the present invention to provide a holder for a documentation cartridge which substantially overcomes the foregoing disadvantages.

It is another object of the present invention to provide a support for a documentation cartridge which permits the cartridge to rest on its spine without tipping when the document sheets are open.

It is a further object of the present invention to provide an inexpensive, light weight support for a documentation cartridge which can double as a length measure.

These and other objects of the present invention, together with the features and advantages thereof, will become apparent from the following detailed specification when read in conjunction with the accompanying drawings in which like parts are designated by identical reference numerals.

DESCRIPTION OF THE INVENTION

Figure 1:
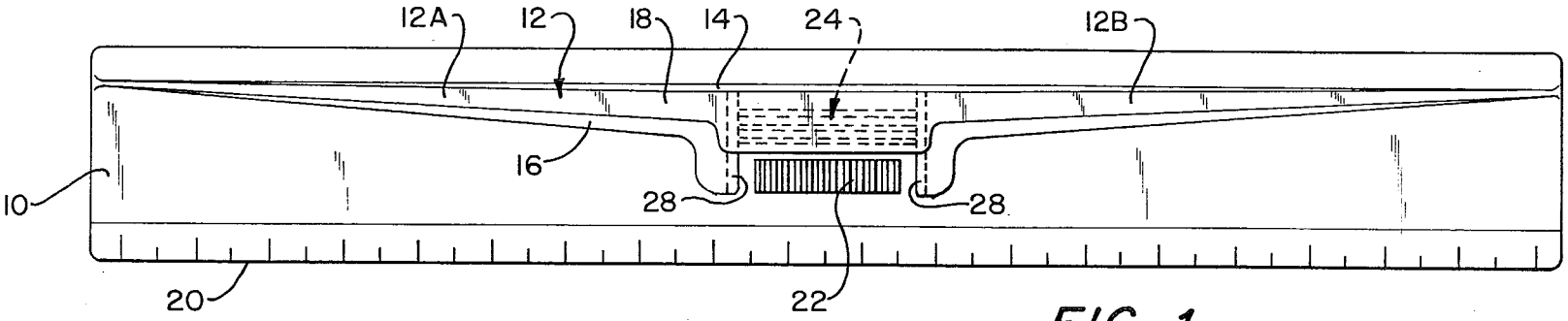
FIG. 1 is a top view of the holder which forms the subject matter of the present invention.

With reference now to the drawings, the holder comprises an elongate base 10 of substantially rectangular form integral with a ridge 12 which rises from the base. Ridge 12 includes a continuous rear wall 14 which substantially perpendicular to the base and which includes a rear surface 15. The slight forward slope of the rear wall shown in the drawings is due primarily to factors having to do with the molding process by which the holder may be made. A front wall 16 of ridge 12 slopes rearwardly with respect to the base and presents a front surface 17. The front and rear walls of ridge 12 are joined by a crest section 18 which defines the upper ridge contour.

Figure 4:
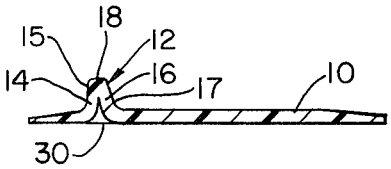
FIG. 4 is a cross sectional view of the apparatus of FIG. 2 taken at line 4—4.
Figure 5:
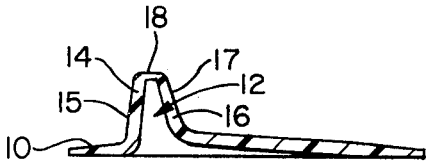
FIG. 5 is a cross sectional view of the apparatus of FIG. 2 taken at line 5—5.
Figure 6:
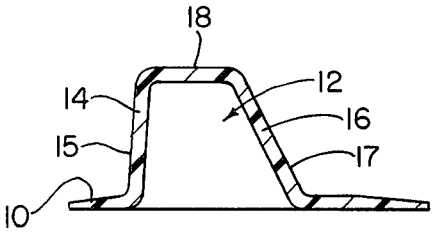
FIG. 6 is a cross sectional view of the apparatus of FIG. 2 taken at line 6—6.

As shown, ridge 12 comprises essentially two substantially identical portions 12A and 12B which are symmetrically disposed with respect to a chamber 26 and which are formed integral with the latter. Chamber 26 is centrally positioned with respect to the long dimension of the base. In a preferred embodiment of the invention, the holder is formed as an integral piece of plastic, with ridge portions 12A and 12B molded as hollow portions, each of which includes a stiffening rib 30 (see FIGS. 2 and 4). The plastic material employed is preferably transparent and graduations are disposed at least along one edge 20 of base 10 to serve as a length measure. Thus, when not in use as a support for a cartridge, the light weight, transparent holder can serve the additional function of a ruler.

Figure 2:
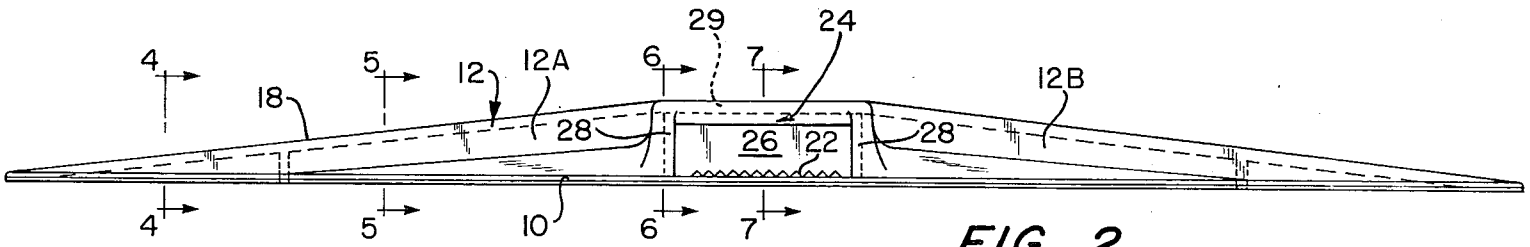
FIG. 2 shows the apparatus of FIG. 1 in elevation view.
Figure 3:
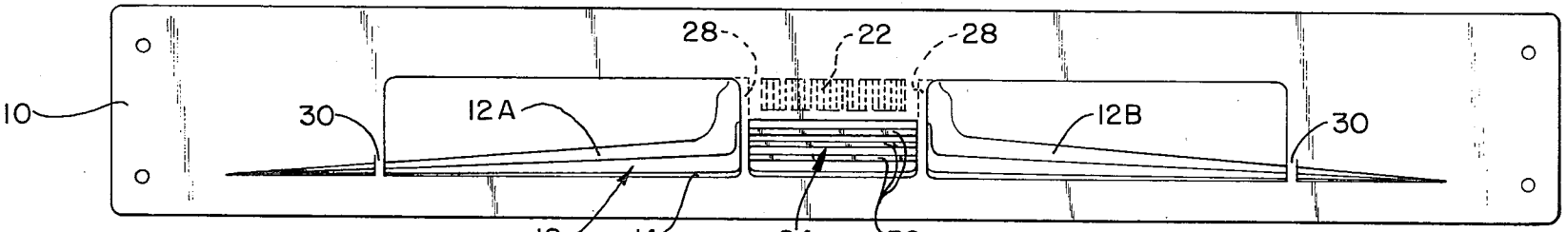
FIG. 3 illustrates the apparatus of FIG. 1 in bottom view.

Chamber 26 extends forward from rear wall 14 between a pair of side walls 28 which are substantially perpendicular to base 10 and transverse to the long dimension thereof. Side walls 28 extend forward beyond front wall 16 so as to define an access opening through the latter. Crest portion 18 slants upward from opposite ends of base 10 and merges into roof 29 of chamber 26. The chamber roof is substantially parallel to base 10 and includes an interiorly depending spline 24. As shown in greater detail in FIGS. 3 and 7, spline 24 comprises a plurality of ribs 32 which face downward from the underside of roof 29. Ribs 32 extend between transverse walls 28 and they are substantially parallel to the long dimension of base 10. The base portion included between transverse walls 28 further includes a plurality of raised, transverse ribs 22 which define notches between them, as best seen in FIG. 2. The forward edges of walls 28 slant rearwardly from base 10 to roof 29. Thus, as viewed from above, roof 29 and therefore spline 24 are displaced to the rear with respect to transverse ribs 22. See FIGS. 1 and 7.

Figure 7:
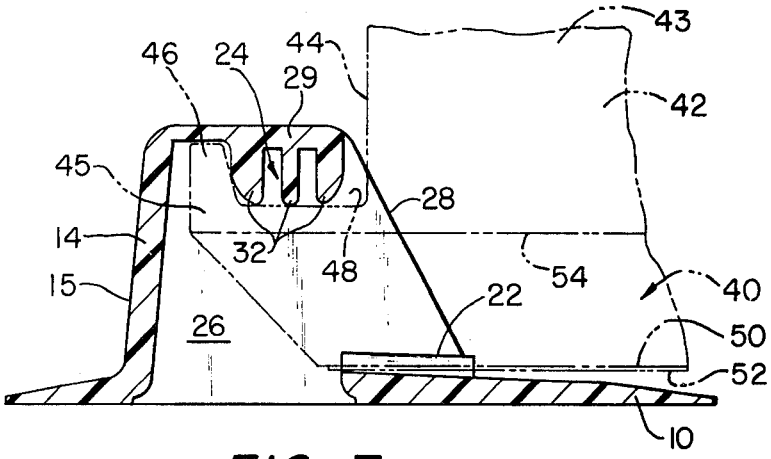
FIG. 7 is an enlarged cross sectional view of the apparatus of FIG. 2 taken at line 7—7.

The operation of the present invention is best seen from the enlarged cross sectional view illustrated in FIG. 7 in which cartridge 40 appears in broken outline. As illustrated, the cartridge is reversed in position from its normal sheet-supporting position. Thus, open portion 43 of channel 42 is facing upward in FIG. 7, while the closed back portion 54 and spine 50 both face downward. As illustrated in greater detail in the above-mentioned patent 3,980,360, cartridge 40 includes a hook 45 which extends beyond end wall 44 of channel 42. As outlined above, the hook preferably takes up the full width of cartridge 40 and thus forms a substantially channel-form slot 48 which runs the width of cartridge 40.

The dimensions of spline 24 are substantially determined by the dimensions and the mutual spacing of ribs 32. Thus, ribs 32 have a depth which is substantially equal to that of slot 48. Further, the distance between the outside ribs 32 determines the width of spline 24. This width is selected to be nearly equal to the width of slot 48, leaving however sufficient clearance to permit the necessary motion for the cartridge to engage the holder.

When engagement between the cartridge and the holder takes place, the cartridge is positioned at right angles to the long dimension of the base. Spine 50 is held in one of the notches defined by transverse ridges 22 which are substantially V-shaped in cross section. Thus, they are capable of holding the spine, whether or not it carries an additional ridgelet 52 as discussed above.

Aside from supporting the cartridge, the notch engaged by the spine keeps the latter from sliding in a sideways direction. The cartridge is prevented from tipping over by the engagement of slot 48 by ribs 32. Although end wall 44 is positioned in close proximity to the forward surface of spline 24, there is sufficient clearance to permit the cartridge to be readily engaged and disengaged. Similarly, the distance between transverse walls 28 is sufficiently large to permit the cartridge spine to be inserted at different points into a number of different notches.

It will be clear that the apparatus disclosed lends itself to a number of different variations and substitutions within the scope of the present invention. For example, instead of the serrated surface presented by transverse ribs 22, a single pair of transverse ribs may be employed with a single notch between them. In one embodiment of the invention, the teeth may fully or partially angle outward with respect to each other in the forward direction so as to facilitate the direction of the cartridge spine.

The spline itself need not consist of discrete parallel ribs. It may, for example, consist of a solid or hollow body having a substantially rectangular cross section. Making the spline with ribs 32 as shown reduces the amount of material used to make the holder while providing stiffness to roof 29.

Although the apparatus described is advantageously molded so that ridge 12 is hollow, the invention is not so limited. Thus, the ridge can be formed as a solid structure mounted on, or integral with, the base and symmetrically disposed with respect to chamber 26. Alternatively, the chamber alone may be formed as a free-standing structure on the base mounted to, or integral with, the latter. Here, the ridge may be dispensed with entirely.

From the foregoing discussion, it will be apparent that numerous modifications, variations, substitutions and equivalents will now occur to those skilled in the art, all of which fall within the spirit and scope contemplated by the invention. Accordingly, it is intended that the invention be limited only by the scope of the appended claims.

What is claimed is:

1. A holder for an elongate channel-form cartridge of the type adapted to support sheets of documents in a hanging position, said cartridge including a spine substantially coextensive with the closed portion of the cartridge channel and a pair of support hooks respectively extending beyond opposite transverse end walls of said channel, each of said hooks being open in the same direction as said channel and defining a slot extending transverse to said channel; said holder comprising:

an elongate flat base;

a ridge rising from said base defined by front and rear surfaces connected by a crest portion;

a chamber in said ridge defined between a pair of mutually spaced walls transverse to the long dimension of said base, said transverse walls being substantially perpendicular to said base and extending forward from said rear surface to form an access opening through said front surface;

the roof of said chamber being formed by said crest portion and including an interiorly depending spline substantially parallel to said long dimension;

the base portion contained between said transverse walls including at least a pair of raised ribs transverse to said long dimension and including a notch therebetween; and said holder being adapted to support said cartridge in a reversed position perpendicular to said long dimension such that said spine is disposed in said notch and one of said hooks engages said spline from below.

2. Apparatus in accordance with claim 1 wherein the slot of said one hook has a substantially channel-shaped cross section and extends substantially the full width of said cartridge; and wherein said spline has a cross sectional configuration adapted to mate with said slot.

3. Apparatus in accordance with claim 2 wherein said spline comprises a plurality of mutually spaced ribs parallel to said long dimension, each of said ribs depending from said roof a distance substantially equal to the depth of said slot, the outside ones of said plurality of depending ribs defining the width of said spline as substantially equal to the width of said slot.

4. Apparatus in accordance with claim 1 wherein said notch has a cross sectional configuration adpated to receive said spine.

5. Apparatus in accordance with claim 4 wherein said notch has a substantially V-shaped configuration.

6. Apparatus in accordance with claim 4 wherein the spacing between said transverse ribs widens in the forward direction to facilitate the entrance of said spine into said notch.

7. Apparatus in accordance with claim 4 wherein said base portion includes a plurality of substantially identical, raised, parallel ribs mutually spaced to define a plurality of said notches therebetween.

8. Apparatus in accordance with claim 1 wherein said holder consists of a transparent material and said base has a rectangular shape, and at least one of the long base edges has graduations thereon adapted to serve for measuring length.

9. Apparatus in accordance with claim 1 wherein portions of said transverse walls extend forward of said front surface, said transverse ribs being positioned between said transverse wall portions.

10. Apparatus in accordance with claim 9 wherein the forward edges of said transverse walls slant rearwardly from said base to said roof, said depending spline being displaced a predetermined distance to the rear with respect to said transverse ribs, said distance being selected to bring the end wall adjacent said slot into proximity with the forward surface of said spline when said cartridge is supported in said reversed position.

11. Apparatus in accordance with claim 1 wherein said ridge is formed as a hollow structure integral with said base and substantially coextensive therewith in length; and a plurality of transverse stiffening ribs positioned within said ridge.

12. Apparatus in accordance with claim 11 wherein said front and rear surfaces of said ridge incline toward each other;

said chamber being centrally positioned on said base; and said crest portion slanting upward from said base to the roof of said chamber from opposite ends of said base.

13. A holder for an elongate channel-form cartridge of the type adapted to support sheets of documents in a hanging position; said cartridge including a spine substantially coextensive with the closed portion of the cartridge channel and a pair of support hooks respectively extending beyond opposite transverse end walls of said channel, each of said hooks being open in the same direction as said channel and defining a slot extending transverse to the latter; said holder comprising:

an elongate flat base;

a chamber positioned on said base, said chamber including a pair of walls substantially perpendicular to said base and transverse to the long dimension thereof, a rear wall extending between said transverse walls, and a roof joining said walls in a plane substantially parallel to said base;

said roof including an interiorly depending spline substantially parallel to said long dimension and adapted to mate with one of said slots, the base portion between said walls including at least a pair of parallel raised ribs tranverse to said long dimension and including a notch therebetween; and said holder being adapted to support said cartridge in a reversed position perpendicular to said long dimension such that said spine is disposed in said notch and one of said hooks engages said spline from below.

14. Apparatus in accordance with claim 13 wherein said roof-supported depending spline is displaced a predetermined distance to the rear of said chamber with respect to said notch on said base portion, said distance being selected to bring the end wall adjacent said one hook into priximity with the forward surface of said spline when said cartridge is supported in said reversed position.

15. Apparatus in accordance with claim 14 wherein said spline comprises a plurality of spaced ribs parallel to said long dimension, each of said last-recited ribs depending from said roof a distance substantially equal to the depth of the slot of said one hook, the outside ones of said plurality of depending ribs defining the width of said spline as substantially equal to the width of said slot.

16. Apparatus in accordance with claim 15 and further including a ridge integral with said chamber and symmetrically positioned relative thereto, said ridge including a crest portion slanting upward from opposite ends of said base to the roof of said chamber.

17. A holder for an elongate channel-form cartridge of the type adapted to support sheets of documents in a hanging position; said cartridge including a spine substantially coextensive with the closed portion of the cartridge channel and a pair of support hooks respectively extending beyond opposite transverse end walls of said channel, each of said hooks being open in the same direction as said channel and defining a slot extending transverse to the latter; said holder comprising:

an elongate flat base having an upper side and a lower side;

means integral with said base defining a chamber on the upper side of said base, said means including a pair of walls projecting up from said base and extending transverse to the long dimension thereof, and a roof joining said walls in a plane substantially parallel to said base, said walls and roof coacting to define an access opening to said chamber and said roof including an interiorly depending spline substantially parallel to said long dimension and adapted to mate with one of said cartridge slots; and means integral with said base at said access opening defining a notch extending transverse to said long dimension;

said holder being adapted to support said cartridge in a reversed position perpendicular to said long dimension such that said spine is disposed in said notch and one of said hooks engages said spline from below.

* * * * *

UNITED STATES PATENT AND TRADEMARK OFFICE

CERTIFICATE OF CORRECTION

PATENT NO. : 4,113,330

DATED : September 12, 1978

INVENTOR(S) : Jerome M. O'Toole and Edmund T. Paquette

It is certified that error appears in the above-identified patent and that said Letters Patent are hereby corrected as shown below:

| | |
|---|---|
| Column 1, Line 46: | Delete word "additionall" and substitute therefor the word "additionally" |
| Column 2, Line 50: | Insert after the word "which" the word "is" |
| Column 4, Line 9: | Delete the word "direction" and substitute therefor the word "insertion" |
| Column 6, Line 20: | Delete the word "priximity" and substitute therefor the word "proximity" |

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*